US005800224A

United States Patent [19]

Ogino

[11] Patent Number: 5,800,224

[45] Date of Patent: Sep. 1, 1998

[54] SPLASH AND ANTI-CAVITATION PLATE FOR MARINE DRIVE

[75] Inventor: Hiroshi Ogino, Hamamatsu, Japan

[73] Assignee: Sanshin Kogyo Kabushiki Kaisha, Japan

[21] Appl. No.: 708,640

[22] Filed: Sep. 5, 1996

[30] Foreign Application Priority Data

Sep. 6, 1995 [JP] Japan ..... 7-228962

[51] Int. Cl.[6] ..... B63H 1/18

[52] U.S. Cl. ..... 440/66; 440/78

[58] Field of Search ..... 440/65, 66, 67, 440/68, 78, 900, 113

[56] References Cited

U.S. PATENT DOCUMENTS

| | | | |
|---|---|---|---|
| 2,021,309 | 11/1935 | Irgens . | |
| 3,025,824 | 3/1962 | Foster . | |
| 3,434,447 | 3/1969 | Christensen et al. | 440/66 |
| 3,487,803 | 1/1970 | Alexander, Jr. . | |
| 3,745,964 | 7/1973 | Henrich | 440/66 |
| 4,323,355 | 4/1982 | Kondo . | |
| 4,529,387 | 7/1985 | Brandt | 440/66 |
| 4,738,644 | 4/1988 | Happel | 440/66 |
| 4,744,779 | 5/1988 | Koehler | 440/66 |
| 4,756,265 | 7/1988 | Lane | 440/66 |
| 4,875,882 | 10/1989 | Plitt et al. | 440/66 |

*Primary Examiner*—Stephen Avila

*Attorney, Agent, or Firm*—Knobbe, Martens, Olson & Bear, LLP

[57] ABSTRACT

An integrated splash and anti-cavitation plate is provided for an outboard motor. The integrated plate decreases the overall weight of the outboard motor in order to improve the motor's performance. The decreased weight also lessens the load on the mounting structure which supports the outboard motor on the watercraft transom. In addition, the distance between the plate and the rotational axis of the propulsion shaft is such that the plate can effectively prevent water splash-up into the mounting structure, even when the outboard motor is run with its propellers partially exposed.

17 Claims, 3 Drawing Sheets

SPLASH AND ANTI-CAVITATION PLATE FOR MARINE DRIVE

BACKGROUND OF THE INVENTION

1. Field of the Invention

The present invention relates to a marine drive, and in particular to a splash and anti-cavitation plate used in conjunction with a marine drive.

2. Description of the Related Art

Many watercraft employ outboard motors that are mounted on the aft end of the watercraft. An outboard motor generally includes a power head that houses an engine, a drive shaft housing situated below the power head, and a lower unit that is positioned below the drive shaft housing. The lower unit typically houses a transmission and a propulsion shaft that drives a propulsion device, such as a propeller.

As a watercraft accelerates through water, it is generally desirable that the propellers remain totally submerged. However, as the propellers spin through the water at high speeds they often draw air into the water. The air may cavitate about the spinning propellers, which is generally undesirable during acceleration of the watercraft. Hence, an anti-cavitation plate conventionally is positioned above the propellers. The anti-cavitation plate commonly depends outward from the lower unit to extend over the propellers and prevent the propellers from drawing air into the water.

As the watercraft travels through water, water impinges against the front of the lower unit and tends to splash upward between the ransom of the boat and the outboard motor. It is generally undesirable that the water splash into the watercraft or onto the mounting structure between the watercraft and the outboard drive. Hence, prior outboard motors conventionally employ a separate splash plate that is positioned above the anti-cavitation plate. The splash plate extends from the forward side of the drive shaft housing and serves to block water from splashing upwardly between into the watercraft and the outboard motor.

There are certain drawbacks associated with positioning a separate splash plate above the anti-cavitation plate. First, the drive shaft housing and the lower unit must have sufficient length for both a splash plate and an anti-cavitation plate, resulting in an increased vertical length of the outboard motor. This translates into an increased overall weight of the outboard drive. This is undesirable, as the mounting structure between the drive and the watercraft must be reinforced, which results in a more costly and time-consuming manufacturing process. Moreover, the increased weight of the outboard drive also increases the amount of weight that the engine must propel, which reduces the efficiency of the outboard motor.

Additionally, the outboard motor on many boats is mounted high so as to run the propellers partially surfaced during high speed operation. However, mounting the outboard motor high also increases the elevation of the splash plate relative to the water surface. This reduces the effectiveness of the splash plate, which may be too high relative to the water surface to effectively block water from splashing onto the mounting structure or into the watercraft.

SUMMARY OF THE INVENTION

A need therefore exists for a marine outboard drive that is equipped with a integrated splash and anti-cavitation plate that reduces the weight of the outboard drive while preventing water splash-up and unintentional propeller cavitation.

One aspect of the present invention thus involves an outboard drive including a lower casing. The lower casing supports a propulsion device on its rear side. An exhaust discharge passage extends through at least a portion of the casing and coplanar first and second portions extend from the casing. The first portion projects beyond a front end of the lower casing and the second portion extends directly over at least a portion the propulsion device on the rear side of the lower casing. The position of the first portion prevents splash-up and the position of the second portion prevents the propellers from drawing air into the water.

Another aspect of the present invention involves an outboard drive including a lower casing which supports a propulsion device on its rear side. A transmission is coupled to the propulsion device and is disposed within the lower casing. A plate projects beyond a front end of the lower casing and extends directly over at least a portion the propulsion device on the rear side of the lower casing.

In accordance with an additional aspect of the present invention, a watercraft is provided which includes a hull. The hull has a bottom surface and an aft end. An outboard drive of the watercraft includes a lower casing which supports a propulsion device at its rear side. The outboard drive is mounted on the aft end of the hull at a position relative to the bottom surface such that the propulsion device operates entirely beneath a surface of a body of water in which the watercraft is operated when the watercraft is idling. The mount position also results in the propulsion device operating at least partially above the surface of the body of water when the watercraft is planing. The outboard drive includes a plate which projects beyond a front end of the lower casing and covers the propulsion device at the rear end of the lower casing. The plate is arranged on the lower casing to lie at the surface of the body of water when the watercraft is at idle.

BRIEF DESCRIPTION OF THE DRAWINGS

These and other features of the invention will now be described with reference to the drawings of a preferred embodiment of the present marine propulsion system. The illustrated embodiment of the marine propulsion system is intended to illustrate, but not to limit the invention. The drawings contain the following figures.

DETAILED DESCRIPTION OF THE PREFERRED EMBODIMENT

Figure 1:
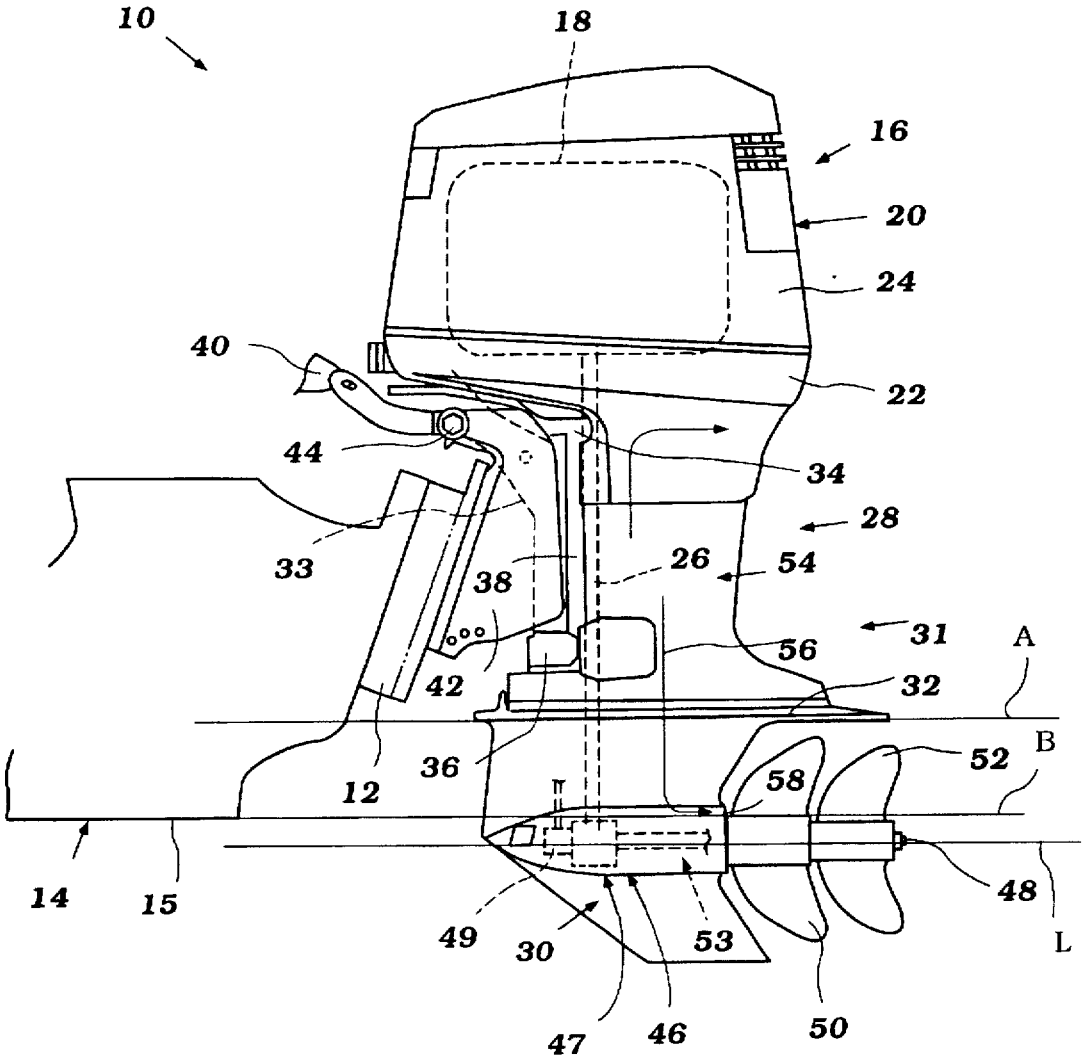
FIG. 1 is a side elevational view of an outboard motor which incorporates a splash and anti-cavitation plate that is configured in accordance with a preferred embodiment of the present invention.

FIG. 1 illustrates a marine drive 10 configured in accordance with the preferred embodiment of the present invention. In the illustrated embodiment, the marine drive 10 is depicted as an outboard motor for mounting on a transom 12 of the watercraft 14 having a bottom surface 15. It is contemplated, however, that those skilled in the art will readily appreciate that the present invention can be applied to stem drive units of inboard/outboard motors, and to other types of watercraft drive units, as well. Thus, as used herein, "outboard drive" generically means an outboard motor, an inboard/outboard motor including a stern drive, and similar marine drive units. Additionally, "front" and "rear" are used herein in reference to the transom 12 of the watercraft 14.

In the illustrated embodiment, the outboard motor 10 has a power head 16 which desirably includes an internal combustion engine 18. The internal combustion engine 18 can have any number of cylinders and cylinder arrangements, and can operate on a variety of known combustion principles (e.g., on a two-stroke or a four-stroke principle).

A protective cowling assembly 20 surrounds the engine 18. The cowling assembly 20 includes a lower tray 22 and a top cowling 24. The tray 22 and the cowling 24 together define a compartment which houses the engine 18 with the lower tray 22 encircling a lower portion of the engine 18.

The engine 18 is mounted conventionally with its output shaft (i.e., a crankshaft) rotating about a generally vertical axis. The crankshaft (not shown) drives a drive shaft 26, as known in the art. The drive shaft 26 depends from the power head 16 of the outboard motor 10.

A drive shaft housing 28 extends downwardly from the lower tray 20 and terminates in a lower unit 30. The drive shaft 26 extends through the drive shaft housing 28 and is suitably journaled therein for rotation about the vertical axis. The drive shaft housing 28 and lower unit 30 collectively define a casing 31.

A plate 32 extends outward in a substantially horizontal direction at the junction between the drive shaft housing 28 and the lower unit 30. The structure and function of the plate 32 is described in detail below.

A conventional steering shaft assembly 33 is affixed to the drive shaft housing 28 by upper and lower brackets 34, 36. The brackets 34, 36 support the steering shaft assembly 33 for steering movement. Steering movement occurs about a generally vertical steering axis which extends through a steering shaft 38 of the steering shaft assembly 33. A steering arm 40, which is connected to an upper end of the steering shaft 38, can extend in a forward direction for manual steering of the outboard motor 10, as known in the art.

The steering shaft assembly 33 also is pivotably connected to a clamping bracket 42 by a pin 44. This convention coupling permits the outboard motor 10 to be pivoted relative to the pin 44 to permit adjustment of the trim position of the outboard motor 10 and for tilt-up of the outboard motor 10.

Although not illustrated, it is understood that a conventional hydraulic tilt-and-trim cylinder assembly, as well as a conventional steering cylinder assembly, can be used as well with the present outboard motor 10. The construction of the steering and trim mechanisms is considered to be conventional, and for that reason, further description is not believed necessary for an appreciation or understanding of the present invention.

Figure 2:
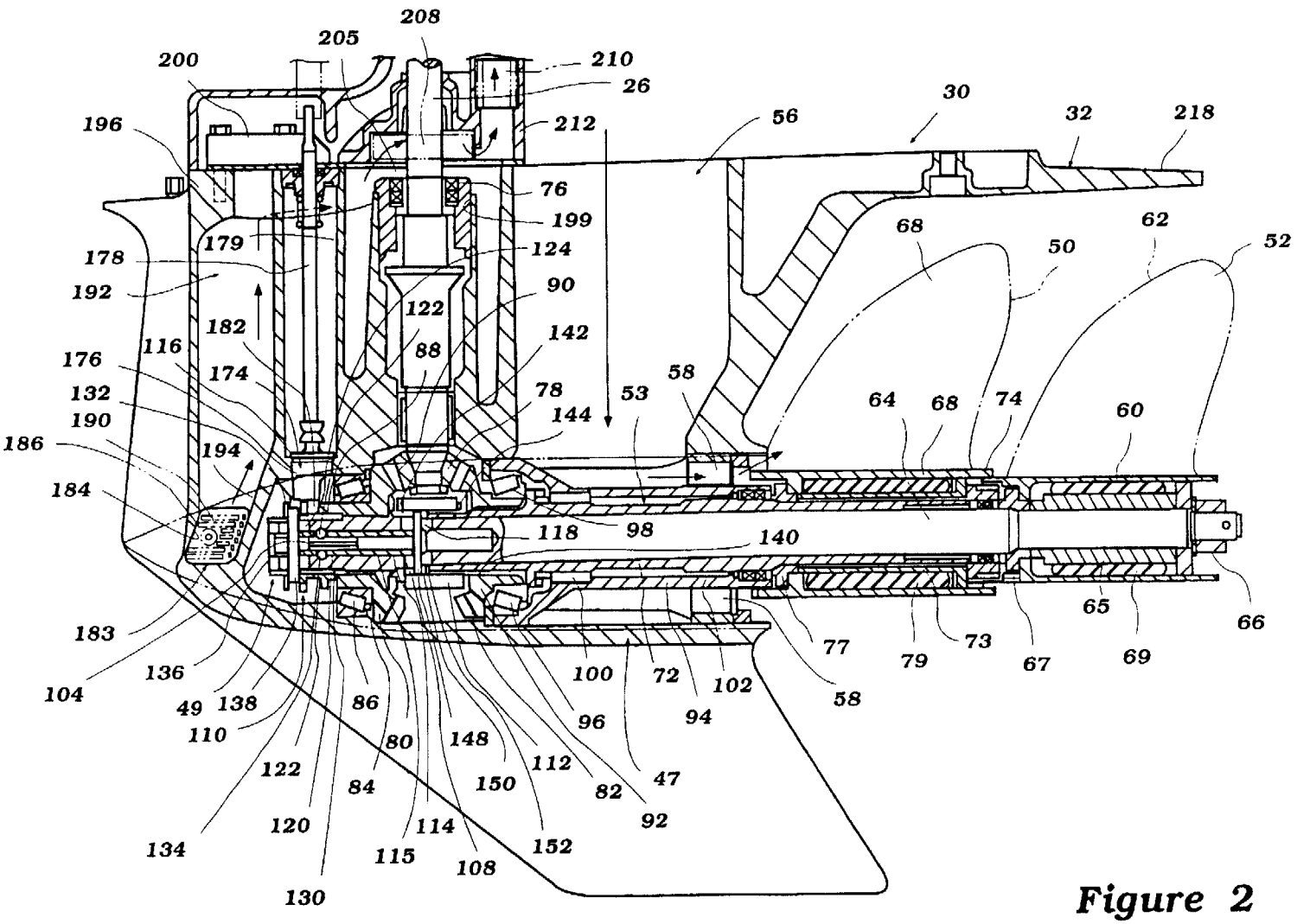
FIG. 2 is a sectional, side elevational view of a lower unit of the outboard motor of FIG. 1 illustrating the splash and anti-cavitation plate, transmission and a propulsion device of the outboard motor which includes a propulsion shaft assembly.

With reference to FIGS. 1 and 2, the drive shaft 26 continues from the drive shaft housing 28 into the lower unit 30, where it drives a transmission 46, which is housed within a nacelle 47. The transmission 46 selectively establishes a driving condition of a propulsion device 48, which can take the form of a propeller, a hydrodynamic jet, or like propulsion device. A shift mechanism 49 advantageously operates the transmission 46 in forward/neutral/reverse states. In this manner, the propulsion device 48 can drive the watercraft 14 in any of these three operational states.

The nacelle 47 is integrally connected with the lower unit 30. The front end of the nacelle is tapered in the forward direction.

With reference to FIG. 1, the level of the water relative to the watercraft 14 desirably lies along the line A as the watercraft is at rest (i.e., idling) is accelerating from low speeds, or is decelerating, as well as during low speed operation of the watercraft. The propellers 50, 52 are thus entirely submerged beneath water during low speed operation and acceleration/deceleration of the watercraft 14. In this position, the plate 32 lies at the surface of the body of water in which the watercraft is operated.

During high speed operation of the watercraft 14, the water level desirably lies along the line B. As shown in FIG. 1, line B generally coincides with the bottom surface 15 of the watercraft 14. Hence, the watercraft 14 desirably planes along the water surface during high speed operation. Furthermore, only the lower portions of the propellers 50, 52 contact the water while the watercraft 14 is operating at high speeds. The propeller blades run partially exposed to reduce drag on the outboard motor 10, as known in the art. In this operational state, the nacelle 47 remains in contact with the water while the rotational axis of the propellers 50, 52 lie below the bottom 15 of the watercraft hull 14.

The present transmission 46 is particularly well suited for use with a counter-rotating propulsion device 48. The counter-rotating propulsion device 48, which is illustrated in FIGS. 1 and 2, includes a front propeller 50 designed to spin in one direction and to assert a forward thrust, and a rear propeller 52 which is designed to spin in an opposite direction and to assert a forward thrust. The propellers 50, 52 thus are of opposite hand and rotate about a propeller shaft 53 having a longitudinal axis L. The construction of the propellers will be described below.

An exhaust system discharges engine exhaust from an engine manifold of the engine 18. The engine manifold of the engine 18 communicates with an exhaust conduit formed within an exhaust guide positioned at the upper end of the drive shaft housing 28. The exhaust conduit of the exhaust guide opens into an expansion chamber 54. The expansion chamber 54 is formed within the drive shaft housing 28 and communications with a discharge conduit 56 (see FIG. 2) formed within the lower unit 30. The discharge conduit 56 terminates at a discharge end 58 formed on the rear side of the lower unit 30. The expansion chamber 54 also communicates with an auxiliary exhaust passage 57 that terminates at an exhaust port 59 formed on the rear side of the drive shaft housing 28. In this manner, engine exhaust is discharged into the water in which the watercraft 14 is operating and in the vicinity of the propellers 50, 52 to produce a cavitation effect about the front propeller 50 to thereby improve acceleration from low speeds. A portion of the exhaust gases also can flow through the auxiliary exhaust passage 57, especially when excessive back-pressure occurs at the discharge end 58 on the lower unit 30.

FIG. 2 illustrates the components of the front and rear propellers 50, 52. The rear propeller includes a hub 60 to which propeller blades 62 are integrally attached. An inner propulsion shaft 64 drives the rear propeller hub 60. For this purpose, the rear end of the inner propulsion shaft 64 carries an engagement sleeve 65 which has a spline connection with the rear end of the rear propulsion shaft 64. The sleeve 65 is fixed to the rear end of the inner shaft 64 between a nut 66 threaded on the rear end of the shaft 64 and a rear thrust washer 67 positioned between the front and rear propeller 50, 52.

An elastic bushing 69 is interposed between the engagement sleeve 65 and the rear propeller hub 60 and is compressed therebetween. The bushing 69 is secured to the engagement sleeve 65 by a heat process known in the art.

The frictional engagement between the hub 60 and the elastic bushing 69 is sufficient to transmit rotational forces from the engagement sleeve 65, driven by the inner propulsion shaft 64 to the rear propeller blades 50. The bushing 69 provides vibrational damping between the drive shaft 64 and the propeller hub 60.

The front propeller 50 likewise includes a propeller hub 68. Propeller blades 70 are integrally formed on the exterior of the hub 68.

An outer propulsion shaft 72 carries the front propeller 50. As best seen in FIG. 2, the rear end portion of the outer propulsion shaft 72 carries a front engagement sleeve 73 and drives the engagement sleeve 73 thereabouts by a spline connection. The front engagement sleeve 73 is secured onto the outer propulsion shaft between an annular retaining ring 74 and a front thrust valve 77.

A front annular elastic bushing 79 surrounds the front engagement sleeve 73. The bushing 79 is secured to the sleeve 73 by a heat process known in the art.

The front propeller hub 68 surrounds the elastic bushing 79, which is held under pressure between the hub 68 and the engagement sleeve 73 in frictional engagement. The frictional engagement between the propeller hub 68 and the bushing 79 is sufficient to transmit a rotational force from the sleeve 73 to the propeller blades 50 of the front propeller hub 68. Again, the elastic bushing 79 affords vibrational damping between the outer propulsion shaft 72 and the front propeller hub 68.

In the illustrated embodiment, the outer propulsion shaft 72 has a tubular shape. The inner propulsion shaft 64 extends through the outer propulsion shaft 74. The shafts 64, 72 desirably are coaxial and rotate about a common longitudinal axis L.

The engine 18 drives the propeller shafts 64, 72 through a drive train formed at least in part by the drive shaft 26 and the transmission 49. The individual components of the present transmission 46 will now be described in detail with reference to FIG. 2.

As seen in FIG. 2, the lower end of the drive shaft 26 is suitably journaled within the lower unit 30 by a pair of bearing assemblies 76. At its lower end, the drive shaft 26 carries a drive gear or pinion 78 which forms a portion of the transmission 46. The pinion 78 preferably is a bevel-type gear.

The transmission 46 also includes a pair of counter-rotating driven gears 80, 82 that are in mesh engagement with the pinion 78. The pair of driven gears 80, 82 preferably are positioned on diametrically opposite sides of the pinion 78, and are suitably journaled within the lower unit 30, as described below. Each driven gear 80, 82 is positioned at about a 90° shaft angle with the drive shaft 26. That is, the propulsion shafts 68, 72 and the drive shaft 26 desirably intersect at about a 90° shaft angle; however, it is contemplated that the drive shaft 26 and the propulsion shafts 64, 72 can intersect at almost any angle.

In the illustrated embodiment, the pair of driven gears 80, 82 are a front bevel gear 80 and an opposing rear bevel gear 82. The front bevel gear includes a hub 84 which is journaled within the lower unit 30 by a front thrust bearing 86. The thrust bearing 86 rotatably supports the front gear 80 in mesh engagement with the pinion 78.

As seen in FIG. 2, the hub 84 has a center bore through which the inner propulsion shaft 64 passes. The inner propulsion shaft 64 is suitably journaled within the central bore of the front gear hub 84.

The front gear 80 also includes a series of teeth 88 on an annular front-facing engagement surface, and includes a series of teeth 90 on an annular rear-facing engagement surface. The teeth 88, 90 on each surface positively engage a portion of a clutch of the transmission 46, as described below.

The rear gear 82 also includes a hub 92 which is suitably journaled within a bearing carrier 94 by a rear thrust bearing 96. The rear thrust bearing rotatably supports the rear gear 82 in mesh engagement with the pinion 78.

The hub 92 of the rear gear 82 has a central bore through which the inner propulsion shaft 64 and the outer propulsion shaft 72 pass. The rear gear 82 also includes an annular front engagement surface which carries a series of teeth 98 for positive engagement with a clutch of the transmission 46, as described below.

As best seen in FIG. 2, the bearing carrier 94 rotatably supports the hollow outer propulsion shaft 72 within the lower unit 30. A front needle bearing 100 journals the front end of the outer propulsion shaft 72 within the bearing carrier 94. A rear needle bearing 102 supports the outer propulsion shaft 72 within the bearing carrier 94 at an opposite end of the bearing carrier 94 from the front needle bearing 100.

As best seen in FIG. 2, the inner propulsion shaft 64 extends through the front gear hub 84 and the rear gear hub 92 and is suitable journaled therein. On the rear side of the rear gear 82, the inner propulsion shaft 64 extends through the outer propulsion shaft 72 and is suitable journaled therein.

As seen in FIG. 2, the front end of the inner propulsion shaft 64 includes a longitudinal bore 104. The bore 104 extends from the front end of the inner shaft 64 to a point within the hub 92 of the rear gear 82. The longitudinal bore 104 communicates with lubricant passages within the inner shaft 64 positioned at the rear end of the longitudinal bore 104. A front aperture 106 extends through the inner shaft 64, transverse to the axis of the longitudinal bore 104, at a position forward of the front bevel gear 80. The inner shaft also includes a rear aperture 108 that extends transversely to the longitudinal axis L of the inner shaft and is generally symmetrically positioned between the front bevel gear 80 and the rear bevel gear 82.

As seen in FIG. 2, the transmission 46 also includes a front clutch 110 and a rear clutch 112 coupled to a plunger 114. As discussed in detail below, the front clutch 110 selectively couples the inner propulsion shaft 64 to the front gear 80. The rear clutch 112 selectively couples the outer propulsion shaft 72 either to the front gear 80 or to the rear gear 82. FIG. 2 illustrates the front clutch 110 and the rear clutch 112 set in a neutral position (i.e., in a position in which the clutches 110, 112 do not engage either the front gear 80 or the rear gear 82). In the illustrated embodiment, the clutches 110, 112 are positive clutches, such as, for example, dog clutch sleeves; however, it is contemplated that the present transmission 46 could be designed with friction-type clutches.

The plunger 114 includes a generally cylindrical rod-shape body 115 and slides within the longitudinal bore 104 of the inner shaft 64 to actuate the clutches 110, 112. The plunger 114 desirably is hollow (i.e., is a cylindrical tube).

The plunger 114 includes a front hole 116 that is positioned generally transverse to the longitudinal axis of the plunger 114 and a rear slot 118 that is likewise positioned generally transverse to the longitudinal axis of the plunger 114. The hole 116 and the slot 118 desirably are each located symmetrically in relation to the corresponding apertures 106, 108 of the inner propulsion shaft 64, with the plunger 114 set in the neutral position.

The transmission 46 also includes a neutral detent mechanism 120 to hold the plunger 114 (and the coupled clutches 110, 112) in the neutral position. The neutral detent mechanism 120 operates between the plunger 114 and the inner propulsion shaft 64, and is located toward the front end of the inner propulsion shaft 64.

As best seen in FIG. 2, the neutral detent mechanism is formed in part by at least one and preferably two transversely positioned holes in the plunger 114. These holes receive detent balls 122. The detent balls 122 each have a diameter which is slightly smaller than the diameter of each hole.

The inner propulsion shaft 64 includes an annular groove 124 which is formed on the inner wall of the bore 104 through which the plunger 114 slides. The groove 124 is positioned within the bore 104 so as to properly locate the clutches 110, 112 in the neutral position when the detent holes of the plunger 114 coincide with the axial position of the annular groove 124. A spring plunger 126, formed in part by a helical compression spring, biases the detent balls 122 radially outwardly against the inner wall of the inner propulsion shaft bore 104. The plunger 114 contains the spring plunger 126 within its tubular body 115.

The spring plunger 126 forces portions of the detent balls 122 into the annular groove 124 when the plunger 114 is moved into the neutral position. This releasable engagement between the detent balls 122 carried by the plunger 114 and the annular groove 124 of the inner propulsion shaft 64 releasably restrains movement of the plunger 114 relative to the inner propulsion shaft 64, as known in the art. Because the detent mechanism 120 is believed to be conventional, further description of the detent mechanism 120 is thought unnecessary for an understanding of the present transmission 46.

As seen in FIG. 2, the front dog clutch 110 has a generally cylindrical shape that includes an axial bore. The bore extends through an annular front end and a flat annular rear end of the clutch 110. The bore is sized to receive the inner propulsion shaft 64. Internal splines are formed on the wall of the axial bore. The internal splines mate with external spines formed on the front end of the inner propulsion shaft 64. The resulting spline connection establishes a driving connection between the front clutch 110 to the inner propulsion shaft 64, while permits the clutch 110 to slide along the front end of shaft 110.

The annular rear end surface of the clutch 110 lies generally transverse to the longitudinal axis L of the inner propulsion shaft 64. The rear surface of the front dog clutch 110 also is substantially coextensive in the area with the annular front surface of the front gear 80. Teeth 130 extend from the clutch rear surface in the longitudinal direction and desirably corresponds with the teeth 88 on the front surface of the front driven gear 80, both in size (i.e., axial length), in number, and in configuration.

A pair of annular grooves circumscribe the exterior of the front clutch 110. A front groove 132 is sized to receive a retaining spring, as described below. The rear groove 134 is sized to cooperate with an actuator mechanism, which will be described below.

The front clutch also includes a traverse hole 136 that extends through the clutch 110 at the location of the front annular groove 132. The hole 136 is sized to receive a pin 138 which, when passed through the front aperture 106 of the inner propulsion shaft 64 and through the front hole 116 of the plunger 114, interconnects the plunger 114 and the front clutch 110 with the front clutch 110 positioned on the inner propulsion shaft 64. The pin 138 may be held in place by a press-fit connection between the pin 138 and the front hole 136, or by a conventional coil spring (not shown) which is contained within the front annular groove 132 about the exterior of the front clutch 110.

The rear clutch 112 is disposed between the two counter-rotating driven gears 80, 82. The rear clutch 112 has a tubular shape that includes an axial bore 140 which extends between an annular front end and an annular rear end. The bore 140 is sized to receive a portion of the outer propulsion shaft 72, which is positioned about the inner propulsion shaft 64.

The annular end surfaces of the rear clutch 112 are substantially coextensive in size with the annular engagement surfaces of the front and rear gears 80, 82, respectively. Teeth 142 extend from the front end of the rear clutch 112 and desirably correspond to the respective teeth 90 of the front gear 80 in size (e.g., axial length), in number, and in configuration. Teeth 144 likewise extend from the rear end surface of the rear clutch 112 and desirably correspond to the respective teeth 98 of the rear gear 82 in size (e.g., axial length), in number, and in configuration.

The front engagement end of the rear clutch 112 advantageously carries a greater number of teeth 142 than the rear engagement end of the rear clutch 112 and a greater number teeth than the front clutch 110. In the illustrated embodiment, the front clutch 110 and the rear engagement end of the rear clutch 112 desirably include the same number of clutching teeth 130, 144, respectively. The front engagement end of the rear clutch 112 desirably includes twice as many teeth 142 as the number of teeth on the rear engagement end of the rear clutch 112. In this manner, the torque load per tooth 142 when the rear clutch 112 engages the front gear 80 is about the same as the torque load per tooth 130, 144 when the front clutch 110 engages the front gear 80 and the rear clutch 112 engages the rear gear 82, even though the entire torque transmitted by the drive shaft 26 is being transmitted to the outer propulsion shaft 72 through the rear clutch 112. In addition, the fewer number of teeth involved where the clutches 110, 112 simultaneously engage the gears 80, 82 eases shifting, because registration between the corresponding teeth is achieved quicker.

A spline connection couples the rear clutch 112 to the outer propulsion shaft 72. The clutch 112 thus drives the outer propulsion shaft 72 through the spline connection, yet the clutch 112 can slide along the front end of the shaft 72 between the front and rear gears 80, 82.

As seen in FIG. 2, the rear clutch 112 also includes a counterbore. The counterbore is sized to receive a coupling pin 148 which extends through the rear aperture 108 of the inner propulsion shaft 64 and through the rear slot 118 of the plunger 114. The pin 148 has a diameter smaller than the length of the slot 118. In the illustrated embodiment, the diameter of the pin 148 is about half that of the length of the slot 118.

The ends of the pin 148 desirably are captured by an annular bushing 150 which is interposed between a pair of roller bearings. The assembly of the bushings and bearings is captured between a pair of washers and locked within the counterbore of the rear dog clutch 118 by a retainer ring 152. The roller bearings journal the assembly of the bushing 150 and the pin 148 within the counterbore to allow the bushing 150 and the pin 148 to rotate in an opposite direction from the rear clutch 112. The pin 148, being captured within the counterbore of the rear clutch 112, however, couples the plunger 114 to the rear clutch 112 in order for the plunger 114 to actuate the rear clutch 112.

With reference to FIG. 2, an actuator mechanism 174 moves the plunger 114 of the clutch assembly from a position establishing a forward drive condition, in which the front and rear clutches 110, 112 engage the front and rear gears 80, 82, respectively, through a position of non-engagement (i.e., the neutral position), and to a position establishing a reverse drive condition, in which the rear clutch 112 engages the front gear 110. The actuator mechanism 174 positively reciprocates the plunger 114 between these positions.

The actuator mechanism 174 includes a cam member 176 that connects the front clutch 110 to a rotatable shift rod 178, which is housed within a sealed vertical chamber 179 within the lower unit 30. In the illustrated embodiment, the shift rod 178 is journaled for rotation in the lower unit 30 and extends upwardly to a transmission actuator mechanism (not shown) positioned within the outboard motor cowling 20. The actuator mechanism 174 converts rotational movement of the shift rod 178 into linear movement of the front clutch 110 to move the front clutch 110, as well as the plunger 114 and the rear clutch 112, along the axis L of the propulsion shaft 64, 72.

The cam member 176 is affixed to a lower end of the shift rod 178. The cam member 176 includes an eccentrically positioned drive pin (not shown) which extends downwardly from the cam member 176. The cam member also includes a cylindrical upper portion which is positioned to rotate about the axis of the shift rod 178 and is journaled within the lower unit 30.

A follower 182 of the actuator mechanism generally has a rectangular block-like shape with a retention arm (not shown) depending from one end. The retention arm advantageously depends from the leading edge of the follower 182 relative to the designed rotation of the clutch 110. The retention arm holds the follower 182 on the clutch with the follower 182 captured between the clutch 110 in the rear groove 134 and the lower end of the cam member 176.

The follower 182 also includes a slot which is formed on the upper side of the following member. The slot has a width generally equal to the diameter of the drive pin of the cam member 176. The drive pin extends into the slot of the follower 182 and is captured between the walls of the follower 182.

The follower 182 has a width generally equal to the width of the rear annular groove 134 of the front clutch 110. The height of the follower 182 also generally matches the distance between the lower end of the cam member 176 and the base of the rear groove 134. In this matter, the rear groove 134 receives and captures the follower 182 of the actuator mechanism 174.

The drive pin of the cam member 176 moves both axially and transversely with rotation of the cam member 176 because of the eccentric position of the drive pin relative to the rotational axis of the cam member 176. The aperture of the follower 182 thus desirably has a sufficient length to accommodate the transverse travel of the drive pin as the cam member 176 rotates between positions corresponding to the forward and reverse drive conditions. The axial travel of the drive pin causes the follower 182 and the coupled clutch 110 to move axially, sliding over the inner propulsion shaft 64, as discussed in detail below.

The front clutch 110 thus is coupled to the cam member 176 with the follower 182 cradled between the walls of the rear annual groove 134 on the front clutch 110. The actuator mechanism 74 configured accordingly positively moves the front clutch 110 along the axis of the inner propulsion shaft 64 with rotational movement of the cam member 176 operated by the shift rod 178. The coupling between the actuator mechanism 174 and the front clutch 110, however, allows the front clutch 110 to rotate with the inner propulsion shaft 64 relative to the follower 182 and the cam member 176.

As noted above, the pin 138 connects the front clutch 110 to the plunger 114. This coupling causes the plunger 114 to rotate with the front clutch 110 and the inner propulsion shaft 64. The coupling also conveys the axial movement of the clutch 110 driven by the actuator mechanism 174 to the plunger 114. The plunger 114 consequently moves the rear clutch 112 which travels with the plunger 114.

FIG. 2 illustrates the front and rear clutches 110, 112 in the neutral position, i.e., a position of non-engagement with the gears 80, 82. The detent mechanism 120 maintains the plunger 114 and the coupled clutches 110, 112 in this position.

To establish a forward drive condition, the shift rod 178 rotates the cam member 176 in a manner which moves the drive pin of the cam member 176 axially in the reverse direction. In the illustrated embodiment, clockwise rotation of the shift rod 178 moves the drive pin axially in the rearward direction. The follower 182 thus follows the drive pin to slide the front clutch 110 over the inner propulsion shaft 64. The actuator mechanism 174 thereby forces the front clutch 110 into engagement with the front gear 80, with the corresponding clutch teeth 88, 130 mating. So engaged, the front gear 80 drives the inner propulsion shaft 64 through the internal spline connection between the clutch 110 and the inner propulsion shaft 64. The inner propulsion shaft 64 thus drives the rear propeller 52 in a first direction which asserts a forward thrust.

The forward motion of the clutch 110 also causes the plunger 114 to slide within the longitudinal bore 108 of the inner propulsion shaft in the reverse direction due to the direct coupling of the drive pin 138. The plunger 114 moves the rear coupling pin 148 in the rearward direction to force the rear clutch 112 into engagement with the rear gear 82 with the corresponding teeth 98, 144 mating.

Once the teeth 144 of the rear clutch 112 register with the teeth 98 of the rear gear 82, the rear clutch 112 engages with the rear gear 82. So engaged, the rear gear 82 drives the outer propulsion shaft 72 through the spline connection between the rear clutch 112 and the outer propulsion shaft 72. The outer propulsion shaft 72 thus drives the front propeller 50 (FIG. 2) to spin in an opposite direction to that of the rear propeller 52 and to assert a forward thrust.

To establish a reverse drive condition, the shift rod 178 rotates in an opposite direction so as to move the cam member 176 and the eccentrically positioned drive pin in a direction which moves the drive pin axially in the forward direction. Again, in the illustrated embodiment, clockwise rotation of the shift rod 178 rotates the drive pin so as to move the drive pin axially in the forward direction. The forward movement of the drive pin is transferred to the front clutch 110 through the follower 182. This motion also is transferred to the plunger 114 through the clutch 110 and the corresponding coupling pin 138. The forward motion of the plunger 114 positively forces the rear clutch 112 into engagement with the front gear 80 with the corresponding clutching teeth 90, 142 mating.

Once the corresponding teeth 142, 90 of the rear clutch 112 and front gear 80 register, the front gear 80 and rear clutch 112 engage. So engaged, the front gear 80 drives the outer propulsion shaft 72 through the spline connection between the rear clutch 112 and the outer propulsion shaft 72. The outer propulsion shaft 72 thus drives the front propeller 50 (FIG. 2) in a direction which asserts a reverse thrust to propel the watercraft 14 in reverse.

With reference to FIG. 2, a water inlet 183 is located on each side of the front end of the lower unit 30. Each water inlet 183 is defined by an opening 184 that extends through the lower unit 30 and is located on an upper side of the front portion of the nacelle 47, forward of the transmission 46.

A cover 186 is positioned over each water inlet 183. An outer side of each lid is positioned flush with the outer surface of the nacelle 47. A plurality of openings 190 are located on each cover 186 for the passage of fluid therethrough.

Each opening 184 extends through the nacelle 47 and communicates with a water passage 192 that extends upward through the lower unit 30. The water passage 192 desirably is positioned forward of the transmission 46 and the rotatable shift rod 178. At its lower end, the water passage 192 is separated from the transmission 46 and shift mechanism 49 by a wall 194. Hence, at its lower end, the water passage 192 is defined by the rear wall 194 and an opposite-facing front wall 196, as well as two opposing side walls 197 and 198.

The water passage expands upward above the transmission 46. As discussed, the shift rod 178 is housed within a sealed vertical chamber 179, thus separating the shift rod 178 from the water passage 192. A sealed housing 199 separates the drive shaft 26 from the water passage 192 within the lower unit 30.

With reference to FIG. 2, a water passage lid 200 is mounted onto the upper end of the lower unit 30 and lies within the drive shaft housing 28, immediately above the junction between the drive shaft housing 28 and the lower unit 30. The water passage lid 200 consists of a generally horizontal planar portion 202 which is supported by walls 204 that extend downward therefrom and connect to the top end of the lower unit 30. The water passage lid 200 serves to define the water passage 192 at its upper end.

With reference to FIG. 2, the water passage 192 communicates with a water pump 208. The water pump 208 is located within the drive shaft housing 28 rearward of the water passage lid 200, immediately above the junction where the drive shaft housing 28 meets the lower unit 30.

The water pump 208 communicates with a water tube 210 that is located rearward of the water pump 208. The water tube 210 is defined by a wall 212 that separates the water tube 210 from the discharge conduit 56. The water tube 210 extends upward through the drive shaft housing 28 and communicates with water jackets that extend through the engine 18.

As the watercraft travels through water, the relative velocity between the water and the nacelle 47 urges water through the plurality of openings 190 in the water inlet cover 186. The momentum of the water as it passes through the inlet propels the water upward through the water passage 192, thus filling the water passage 192 with water. The pump 208 also helps draw water into the water passage 192, especially at low speeds. The water pump 208 then pumps the water from the water passage 192 and into the water tube 210. The water tube 210 guides the water to the engine 18 for cooling. The method by which the water, once within the engine, cools the engine is considered to be conventional. For that reason, further description is not believed to be necessary for an appreciation or understanding of the present invention.

With reference to FIG. 1, a plate 32 extends horizontally outward around the perimeter of the casing 31. The plate 32 is desirably located along the junction between the drive shaft housing 28 and the lower unit 30, although the plate 32 may also be positioned above or below the junction. The plate 32 is integrally formed with the drive shaft housing 28. Alternatively, the plate may be integrally formed with the lower unit 30.

Figure 3:
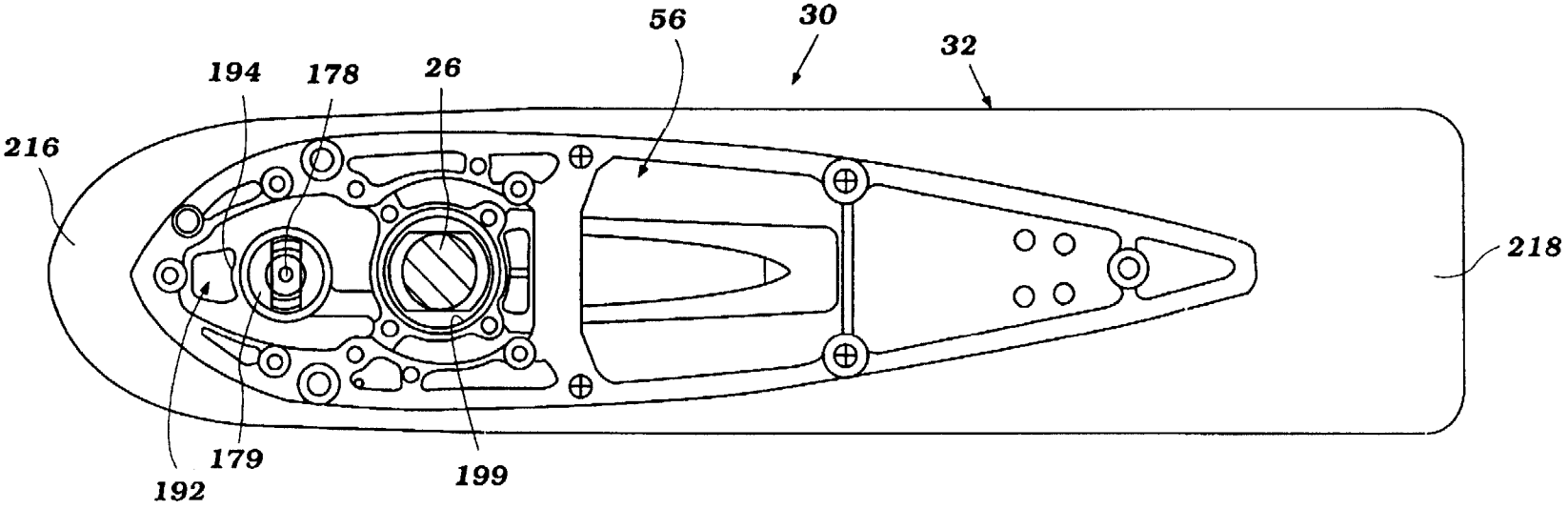
FIG. 3 is a top plan view of the lower unit of the outboard motor of FIG. 1.

As best seen in FIGS. 2 and 3, the plate 32 extends horizontally outward from the casing 31 along the entire perimeter of the casing 31. In the forward direction, a front portion 216 of the plate 32 extends outward from the front and sides of the casing 31. The front edge of the plate 32 desirably forms a rounded shape. In the rearward direction, a rear portion 218 of the plate 32 extends outward from the casing 31 so that the plate 32 substantially overhangs the rear propeller blade 62. In the embodiment illustrated in FIG. 3, the rear portion 218 of the plate 32 entirely covers both propellers 50, 52 of the propulsion device. The rear edge of the plate 32 defines a substantially straight line. Although the illustrated embodiment shows the front and rear planar portions 216, 218 as forming part of the plate 32, it is understood that the front and rear portions 216, 218 could be separate coplanar member.

The plate 32 serves a dual purpose. The front portion 216 of the plate 32 acts as a splash plate. As the watercraft travels through water, the front portion 216 of the plate 32 blocks water from splashing up into the boat or onto the steering and trim mechanisms.

The rear portion 218 of the plate 32 acts as an anti-cavitation plate when the propellers are spinning totally submerged in the water, such as when the watercraft is accelerating and the water surface lies along line A. In such an instance, the plate 32 is interposed between the water surface and the propellers, thus inhibiting the propellers from drawing air into the water, which causes the propellers to unintentionally cavitate.

Certain advantages are associated with a single plate serving as both a splash plate and an anti-cavitation plate. First, because there is only a single plate on the drive shaft housing 28, rather than multiple plates, the combined length of the drive shaft housing 28 and the lower unit 30 may be reduced, as there is no need to provide extra space for a second plate. This translates into a reduced overall weight of the outboard drive 10. Hence, the mounting structure of the drive to the watercraft need not be reinforced, which provides for a simpler and less timely manufacturing process. Moreover, the efficiency of the outboard drive 10 is desirably improved, as it is required to propel less weight.

The plate 32, which serves as a splash plate as well as an anti-cavitation plate, also may be positioned lower relative to the propeller shaft 53 than if a separate splash plate were positioned above an anti-cavitation plate. As a result, the distance between the splash plate and the water level is also reduced. Hence, if the marine drive 10 is mounted high, such as for a high-speed boat, the plate 32 desirably remains low enough relative to the water surface to serve as an effective splash plate. Hence, the present device provides for an improved splash plate and anti-cavitation plate that may be effectively used with high mounted drives.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. An outboard motor comprising an internal combustion engine positioned above a lower casing which supports a propulsion device on a rear side of the lower casing, a transmission couple to the propulsion device and disposed within the lower casing, said engine driving the transmission and being coupled to the transmission by a generally upstanding drive shaft, a steering mechanism being attached to a housing of the outboard motor above the lower casing and defining a steering axis about which the outboard motor can swivel, and a cavitation plate being connected to a portion of the lower casing and having a generally planar shape, said cavitation plate projecting beyond a front end of the lower casing forward of the steering axis and extending directly over at least a portion of the propulsion device on the rear side of the lower casing, said cavitation plate having a generally uniform width at least over a longitudinal section of the cavitation plate between a rear end of the cavitation plate and a point next to the drive shaft, said width being wider than a maximum width of the portion of the lower casing to which the cavitation plate is connected.

2. An outboard drive as in claim 1, wherein the plate extends outwardly around the entire periphery of the lower casing.

3. An outboard drive as in claim 2 additionally comprising an upper casing with the plate being positioned between the upper and lower casings.

4. An outboard motor as in claim 1, wherein the propulsion device includes a pair of counter-rotating propellers which are aligned so as to rotated about a common axis, and the the rear end of the plate extends to a point covering both of the propellers.

5. An outboard motor as in claim 1, wherein the lower casing includes a nacelle in which the transmission is disposed.

6. An outboard motor as in claim 2, wherein the nacelle is positioned on the lower casing in a position where the nacelle is submerged in the body of water in which the outboard drive is operated when the watercraft is idling, and is in contact with the water when the watercraft is planing.

7. An outboard motor as in claim 1 additionally comprising an intermediate casing to which the lower housing is attached, the plate being provided around a junction between the intermediate casing and the lower casing.

8. An outboard motor as in claim 7, wherein the plate is integrally formed around a lower end of the intermediate casing.

9. An outboard motor as in claim 7, wherein the plate is integrally formed around an upper end of the lower casing.

10. A watercraft comprising a hull having a bottom surface and an aft end, and an outboard motor including an internal combustion engine positioned above a lower casing which supports a propulsion device at a rear end of the lower casing, the outboard drive being mounted on the aft end at a position relative to the bottom surface such that the propulsion device operates entirely beneath the surface of a body of water in which the watercraft is operated when the watercraft is idling, and operates at least partially above the surface of the body of water when the watercraft is planing, the outboard motor including a steering mechanism being attached to a housing of the outboard motor above the lower casing and defining a steering axis about which the outboard motor can swivel, and a plate which projects beyond a front end of the lower casing forward of the steering axis and covers the propulsion device at the rear end of the lower casing, the plate being arranged on the lower casing to lie at the surface of the body of water when the watercraft is at idle, said plate having a generally uniform width at least over a longitudinal section of the plate between a rear end of the plate and a point next to the drive shaft, said longitudinal section of the plate being wider than a maximum width of a portion of the lower casing to which the plate is connected.

11. A watercraft as in claim 10, wherein the outboard drive includes an exhaust discharge passage that extends through the lower casing.

12. A watercraft as in claim 10, wherein the outboard drive includes a transmission positioned within the lower casing.

13. A watercraft as in claim 10, wherein the lower casing includes a nacelle, and the nacelle is positioned relative to the plate so as to lie submerged when the watercraft is idling, and to contact the water when the watercraft is planing.

14. A watercraft as in claim 13, wherein the nacelle houses at least one propulsion shaft which drives at least a portion of the propulsion device about a rotational axis, and the nacelle is positioned relative to the plate such that the rotational axis of the propulsion shaft lies beneath the bottom of the watercraft when the watercraft is planing.

15. A watercraft as in claim 10 additionally comprising an upper casing to which the lower casing is attached, the plate being disposed about a junction between a lower end of the upper casing and an upper end of the lower casing.

16. An outboard motor comprising an internal combustion engine positioned above a lower casing which supports a propulsion device on a rear side of the lower casing, a transmission couple to the propulsion device and disposed within the lower casing, said engine driving the transmission and being coupled to the transmission by a generally upstanding drive shaft, a steering mechanism being attached to a housing of the outboard motor above the lower casing and defining a steering axis about which the outboard motor can swivel, and a cavitation plate being connected to a portion of the lower casing and having a generally planar shape, said cavitation plate projecting beyond a front end of the lower casing forward of the steering axis and extending directly over at least a portion of the propulsion device on the rear side of the lower casing.

17. An outboard motor as in claim 16, wherein said cavitation plate having a generally uniform width at least over a longitudinal section of the cavitation plate between a rear end of the cavitation plate and a point next to the drive shaft, said width being wider than a maximum width of the portion of the lower casing to which the cavitation plate is connected.

* * * * *

UNITED STATES PATENT AND TRADEMARK OFFICE

CERTIFICATE OF CORRECTION

PATENT NO. : 5,800,224

DATED : September 1, 1998

INVENTOR(S) : Hiroshi Ogino

It is certified that error appears in the above-identified patent and that said Letters Patent is hereby corrected as shown below:

On the title page, item "[22] Filed: Sep. 5, 1996" should be --[22] Filed: Sep. 6, 1996--.

In Claim 4, column 13, line 31, "the the rear end" should be --the rear end--.

Signed and Sealed this

Seventh Day of December, 1999

*Attest:*

Q. TODD DICKINSON

*Attesting Officer*

*Acting Commissioner of Patents and Trademarks*